US007537014B1

(12) United States Patent
Yoo

(10) Patent No.: US 7,537,014 B1
(45) Date of Patent: May 26, 2009

(54) OPEN SELF-PART FOR WIGS

(76) Inventor: Youngbo Yoo, 138 Kansas St., Hackensack, NJ (US) 07601

( * ) Notice: Subject to any disclaimer, the term of this patent is extended or adjusted under 35 U.S.C. 154(b) by 491 days.

(21) Appl. No.: 10/711,757

(22) Filed: Oct. 4, 2004

(51) Int. Cl.
*A41G 3/00* (2006.01)
*A41G 5/00* (2006.01)

(52) U.S. Cl. ..... 132/53; 132/201

(58) Field of Classification Search ..... 132/201, 132/53–56
See application file for complete search history.

(56) References Cited

U.S. PATENT DOCUMENTS 373,297 A * 11/1887 Marshall ..... 132/53
1,583,778 A * 5/1926 Conley ..... 132/53
2,438,005 A * 3/1948 Goldman ..... 132/53
3,495,603 A * 2/1970 Young, Jr. ..... 132/53
3,809,100 A * 5/1974 Megna ..... 132/53
4,070,790 A * 1/1978 Strongin et al. ..... 446/394
4,576,189 A * 3/1986 Regina ..... 132/53
D518,604 S * 4/2006 Belo ..... D28/92

* cited by examiner

*Primary Examiner*—Robyn Doan
(74) *Attorney, Agent, or Firm*—Richard A Joel, Esq

(57) ABSTRACT

The invention comprises a conventional wig with hair sewn into a net and a metal omega shaped element in the front part of the wig creating an opening through which one's hair is pulled to create a realistic hairline. The metal portion is embedded in fabric for engagement with hook and loop fasteners on a detachable wig portion or wiglet. The detachable wig portion includes a substantially U-shaped plastic element having hook and loop fasteners on the upper portion thereof for attachment to the fabric on the stainless steel portion of the wig.

4 Claims, 3 Drawing Sheets

OPEN SELF-PART FOR WIGS

DESCRIPTION

Figure 1:
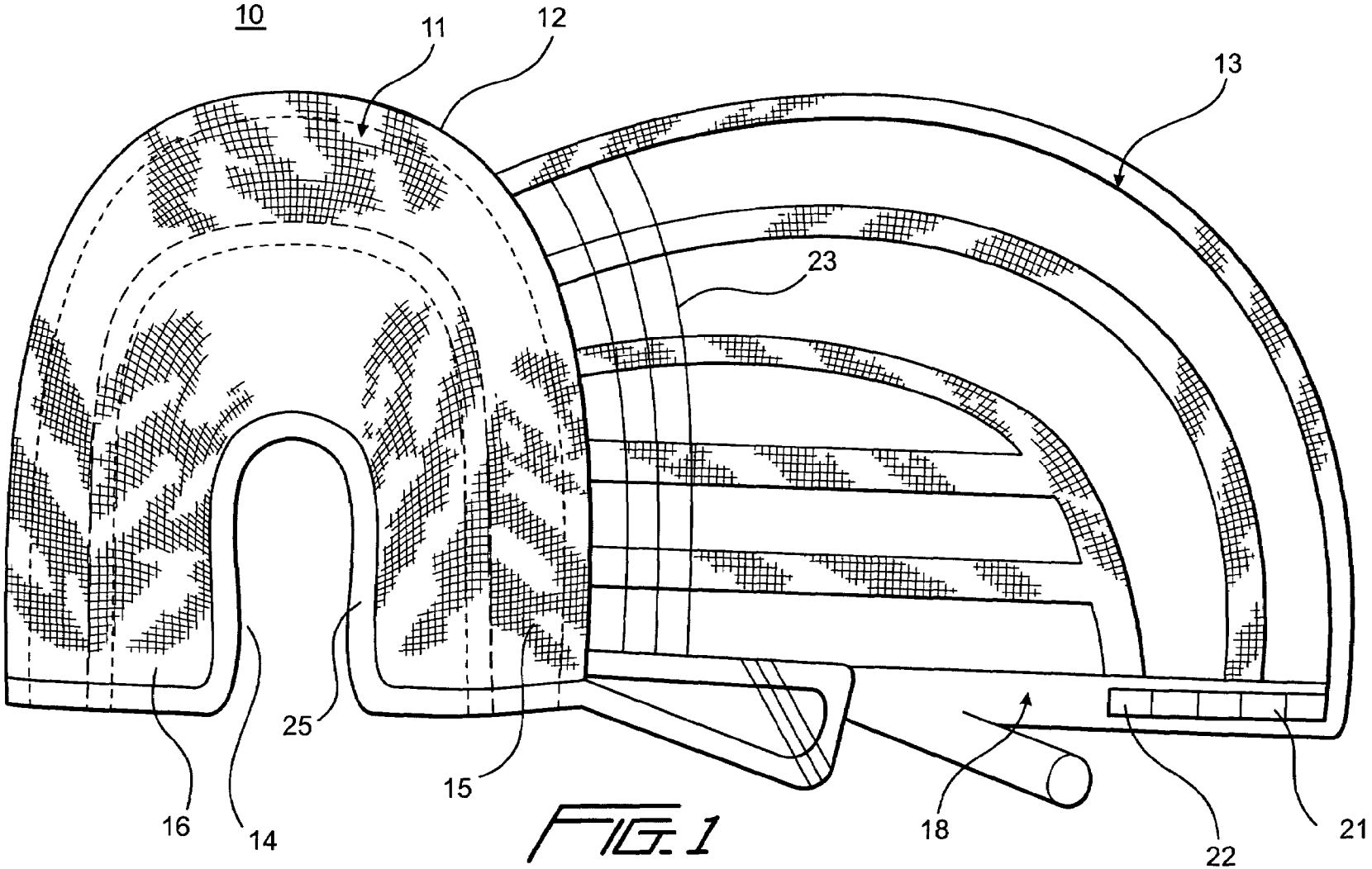

This invention relates to wigs and particularly to wig having a detachable portion along the front part to form a realistic hairline using one's own hair.

The prior art includes U.S. Pat. No. 3,385,305 to Buzzelli which relates to a detachable coiffeur comprising a plurality of wiglets which are readily arranged to form a particular hairstyle. The detachable coiffeur is in the form of a detachable pad that is secured to the crown of a woman's head and a plurality of wiglets that may be quickly and easily attached to or released from the pad.

U.S. Pat. No. 5,952,957 to Gazzerro discloses a hairpiece with detachable portions having continuing fastening segments so that a front base portion of the hairpiece can be detachably connected to a rear base portion.

U.S. Pat. No. 6,691,714 to Yaguchi, et al, discloses a wig utilizing the wearer's own hair wig in which the wearer's own hair is pulled through a space in the wig and blended with false hairs at the time of attaching the wig to the wearer. The wearer's own hair supposedly can be effectively and evenly utilized thus enabling the wig to provide an abundance of hair as a whole.

Other patents of some interest include U.S. Pat. No. 3,968,807 to Kraicer and U.S. Pat. No. 5,419,345 to Kadymir.

None of the foregoing patents discloses the applicant's unique arrangement for providing a natural hairline on a wig with a detachable uniquely shaped wig element at the part and using the individual's own hair pulled through the opening when the wig element is removed.

This invention relates to wigs and particularly to a design sold by Modu Trading Inc. of Hackensack, N.J. as the Omega (Ù) Part™. The invention comprises a conventional wig with hair sewn into a net and a stainless steel omega shaped element in the front part of the wig. The stainless steel portion is embedded in fabric for engagement with hook and loop fasteners on a detachable wig portion or wiglet. The detachable wig portion comprises a mesh base with hair extending outwardly and a substantially U-shaped plastic element having hook and loop fasteners on the upper portion thereof for attachment to the fabric on the stainless steel portion of the wig. When the wearer has sufficient hair and wishes to have a particular hair style with an improved hairline, the detachable wig portion and can be removed, and the individual's hair pulled through the opening. This eliminates the artificial hairline, which reveals itself on most wigs.

Accordingly, an object of this invention is to provide a new and improved wig, which disguises the hairline with an open front portion through which the wearer's hair is pulled.

Another object of this invention is to provide a new and improved wig having a removable wig portion which is detachably secured to the wig body.

A further object of this invention is to provide a new and improved wig which includes a recessed stainless steel portion embedded in fabric to which a front portion is removably attached along the part.

A still further object of this invention includes a new and improved wig having an opening along a predetermined part through which the user's hair may be pulled to create a natural effect or which can be fitted with a detachable wig portion.

A more specific object of this invention is to provide a new and improved wig having a Velcro™ attached shaped portion along a front portion of the part which permits removal creating an opening through which one's hair may be pulled to create a realistic hairline.

The above and other objects of this invention may be more clearly seen when viewed in conjunction with the accompanying drawings wherein, FIG. 1 is a schematic view of the wig cap to which hair is attached showing the "open self part" with a center part design.

Figures 2, 3, 5, 6:
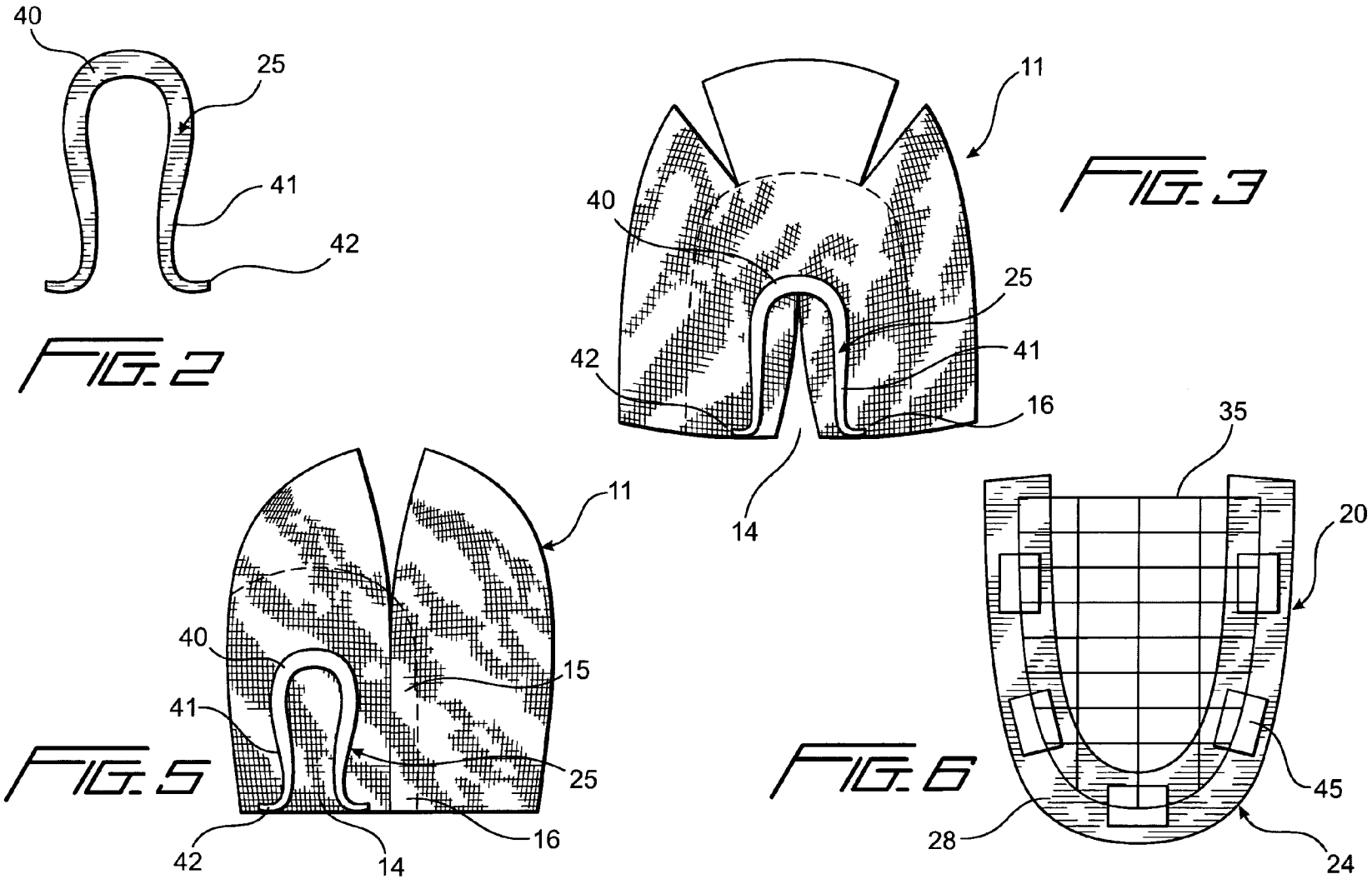

FIG. 2 discloses the stainless steel frame surrounding the open front cap in a top view.

FIG. 3 discloses a top side view of a center part cap.

Figure 4:
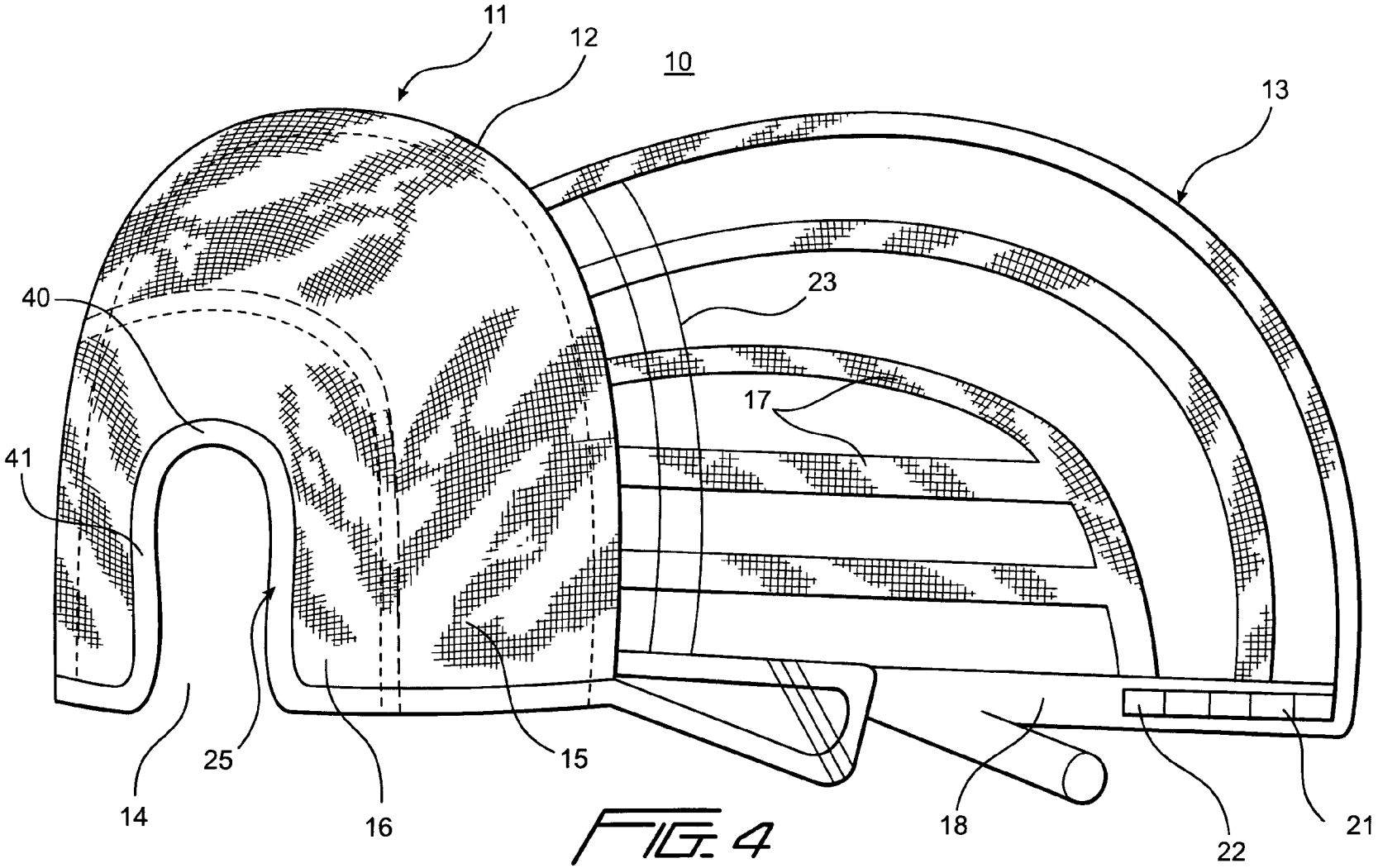

FIG. 4 is a schematic view of the wig cap showing a side part design.

FIG. 5 discloses a top side view of the invention embodied in a side part cap; and, FIG. 6 discloses a detachable wig portion which engages the wig cap of FIG. 1 or 4.

Referring now to FIG. 1 of the drawings, the invention comprises a wig 10 having a cap 11, which includes a top portion 12 and a side/rear portion 13. The top portion 12 includes an aperture 14 having a fabric portion 16 extending about the aperture 14. An Omega shaped metal element 25, having a base 40 and legs 41 which curl outwardly at 42 preferably of stainless steel is mounted about the aperture 14 within the fabric 16. A decorative mesh net 15 is connected to the fabric 16 and extends outwardly therefrom. Elastic lace bands 17 are mounted at one end to the mesh net 15 and at the other end to an outer adjustable band 18 having an elasticized portion 19 and a non-stretch portion 21 with an adjustable coupling 22 therebetween. The side part of the invention is shown in FIG. 4.

A plurality of cross-bands 23 (some of which are shown) are sewn to the elasticized bands 17. The cross-bands 23 are mounted to the bands 18 at each end. Hair is sewn or otherwise attached to the cross-bands 23 and to fabric 16 and net 15. The main portion of the cap 11 is fairly conventional and hence is not described in detail.

A wig portion 20 may be mounted in the part aperture 14 to fill in the wig. The wig portion 20 mounts to the fabric 16, essentially aligning with the Omega shaped metal element 25. The wig portion 20 comprises a substantially Omega or u-shaped plastic element 24 on its lower side and a fine mesh 35 extending over and between the legs 26 and 27 on its upper portion. The upper portion 28 of the element 24 includes a plurality of spaced hook and loop fasteners 45 for mounting to the fabric 16 and filling in the aperture 14. Hair is sewn to the mesh net 15 in a conventional manner so that the wig portion 20 fills in the wig 10 along the center part.

If the wearer has sufficient hair about their part, the wig portion 20 is removed and the wearer's hair is pulled through the aperture 14 and shaped or combed to create a realistic hairline. The fabric 16 includes an Omega shaped stainless steel element 25 as shown in FIG. 2 encased in the fabric 16 to prevent ripping when the wig portion 20 is removed. The detachably removed wig portion 20 may be used with either the center part of FIG. 1 or the side part of FIG. 4. In both cases, the wearer's natural hair creates a natural hairline and more realistic wig.

Thus the wig 10 provides versatility and may be used strictly as a wig 10 or the detachable wig portion 20 may be peeled from the fabric revealing an opening 14. The user's hair may be pulled through the opening 14 creating a natural part either doing the center as in FIG. 1 or on the side as in FIG. 5. A prime feature of the invention is the creation of a natural hairline. This not the case with most wigs. The present invention discloses an attractive, easy to use and inexpensive wig 10 which may be worn with or without the detachable wig portion.

While the invention has been explained by a detailed description of certain specific embodiments, it is understood that various modifications and substitutions can be made in any of them within the scope of the appended claims that are intended also to include equivalents of such embodiments.

What is claimed is:

1. A wig comprises:

a main wig portion with a part separating adjacent portions thereof and having a cap and hair mounted thereto and an opening along the part;

a shaped metal element mounted about the part opening in the wig-cap for the wig cap's structural stability and a fabric portion mounted thereabout, said element having an Omega shape with a base and legs extending outwardly therefrom; and, a detachable wig portion mounted over the opening and removably affixed to the main wig portion, such that when removed, natural hair is permitted to extend therethrough thus creating a natural hairline.

2. A wig in accordance with claim 1 wherein:

the detachable wig portion comprises a substantially Omega shaped portion having a base and legs at each end of the base extending outwardly and leg end portions curving in opposite outward directions and having a mesh covering between said legs and hair mounted therein and hook and loop fasteners mounted thereon to secure said wig portion to the fabric portion of the wig over the wig opening.

3. A wig in accordance with claim 1 wherein:

the detachable wig portion further comprises a plastic lower portion having opposing legs and a base joining said legs and a mesh upper portion mounted between the legs and across the opening and having hair secured to the mesh portion.

4. A wig comprising:

a main wig portion comprising a net with hair attached thereto, an opening along a selected central part;

a detachable wig portion mounted over the opening and removably affixed to the main wig portion, such that when removed, natural hair is permitted to extend therethrough thus creating a natural hairline; and wherein the main wig portion includes an Omega shaped stainless steel element mounted about the opening to provide structural stability and a fabric covering mounted thereover; and, the detachable wig portion includes a mesh portion having hair mounted thereto and a mating portion engaging the fabric covered steel element.

* * * * *